US006860330B2

(12) United States Patent
Jackson

(10) Patent No.: US 6,860,330 B2
(45) Date of Patent: Mar. 1, 2005

(54) CHOKE VALVE ASSEMBLY FOR DOWNHOLE FLOW CONTROL

(75) Inventor: Stephen L. Jackson, Richmond, TX (US)

(73) Assignee: Weatherford/Lamb Inc., Houston, TX (US)

( * ) Notice: Subject to any disclaimer, the term of this patent is extended or adjusted under 35 U.S.C. 154(b) by 18 days.

(21) Appl. No.: 10/321,288

(22) Filed: Dec. 17, 2002

(65) Prior Publication Data

US 2004/0112608 A1 Jun. 17, 2004

(51) Int. Cl.[7] ..... E21B 34/14

(52) U.S. Cl. ..... 166/332.1; 166/320; 166/386

(58) Field of Search ..... 166/332.1, 320, 166/386, 321, 323, 373, 242.1, 316; 137/627.5

(56) References Cited

U.S. PATENT DOCUMENTS

| | | | | |
|---|---|---|---|---|
| 5,263,683 A | * | 11/1993 | Wong | 251/145 |
| 5,285,850 A | | 2/1994 | Bayh, III | 166/321 |
| 5,332,038 A | * | 7/1994 | Tapp et al. | 166/278 |
| 5,906,238 A | * | 5/1999 | Carmody et al. | 166/53 |
| 5,957,207 A | * | 9/1999 | Schnatzmeyer | 166/332.1 |
| 6,044,908 A | | 4/2000 | Wyatt | 166/332.4 |
| 6,189,619 B1 | | 2/2001 | Wyatt et al. | 166/332.1 |
| 6,276,458 B1 | | 8/2001 | Malone et al. | 166/386 |
| 6,305,402 B2 | | 10/2001 | Pringle | 137/155 |
| 6,308,783 B2 | | 10/2001 | Pringle et al. | 166/320 |
| 6,371,208 B1 | | 4/2002 | Norman et al. | 166/334.4 |
| 6,419,022 B1 | | 7/2002 | Jernigan et al. | 166/336 |
| 2002/0020534 A1 | | 2/2002 | Wilson et al. | |
| 2002/0027003 A1 | | 3/2002 | Williamson, Jr. et al. | 166/240 |
| 2002/0096333 A1 | | 7/2002 | Johnson et al. | |

FOREIGN PATENT DOCUMENTS

| | | | |
|---|---|---|---|
| GB | 2 372 519 | 8/2002 | |
| WO | WO 99/63234 | 12/1999 | |
| WO | WO 01/86113 | 11/2001 | E21B/34/12 |
| WO | WO 02/46575 | 6/2002 | E21B/34/06 |
| WO | WO 02/46576 | 6/2002 | E21B/34/06 |

OTHER PUBLICATIONS

U.K. Search Report, Application No. GB0329137.4, dated Apr. 26, 2004.

* cited by examiner

*Primary Examiner*—Frank Tsay
(74) *Attorney, Agent, or Firm*—Moser, Patterson & Sheridan, L.L.P.

(57) ABSTRACT

A choke valve assembly is disclosed for controlling the flow of fluid through a production tubing. The valve assembly includes a housing having a plurality of axially aligned apertures and a ported sleeve disposed in the housing. The ported sleeve has a plurality of rows of fluid ports. Each row of ports has at least one port in selective fluid communication with a respective aperture. In the full open position, each aperture is in fluid communication with a port from each row. To choke the flow, the ported sleeve is rotated relative to the housing to reduce the number of ports in fluid communication with the housing. To close the valve, axial force is applied to move the ported sleeve axially relative to the housing.

42 Claims, 8 Drawing Sheets

CHOKE VALVE ASSEMBLY FOR DOWNHOLE FLOW CONTROL

BACKGROUND OF THE INVENTION

1. Field of the Invention

Embodiments of the present invention generally relate to downhole well tools. Particularly, aspects of the present invention relate to downhole flow valves. More particularly still, aspects of the present invention relate to downhole flow valves used to control the flow of fluid therethrough.

2. Description of the Related Art

Advancements in the oil and gas industry have allowed hydrocarbons in multiple zones of interest to be produced from a single well. One such development is the drilling of multilateral wells, in which a number of lateral wells are drilled from a primary wellbore. In such wells, each wellbore may pass through various hydrocarbon bearing zones or may extend through a single zone for a long distance. Additionally, production may be increased by perforating a wellbore in a number of different locations, either in the same hydrocarbon bearing zone or in different hydrocarbon bearing zones, and thereby increase the flow of hydrocarbons into the well.

One problem associated with producing from a well in this manner relates to the control of the flow of fluids from multiple zones of interest to and from the well. For example, in a well producing from a number of separate zones, or lateral branches in a multilateral well, one zone may have a higher pressure than another zone. As a result, the higher pressure zone may produce into the lower pressure zone rather than to the surface.

Production fluids from one zone may be kept separate from the production fluids of another zone by zonal isolation. Zonal isolation typically involves inserting a production tubing into the well, isolating each of the perforations or lateral branches with packers, and controlling the flow of fluids into or through the tubing. Previous flow control systems typically only provide for either on or off flow control. More recently, flow control systems include a flow throttling feature to further alleviate the aforementioned problems.

Sliding sleeves are commonly employed in pipe strings to open and close access openings in the tubing as well as throttle the flow of fluid through the tubing. An example of a prior art sliding sleeve system is shown in U.S. Pat. No. 5,263,683. The patent discloses an internal sliding sleeve within a ported pipe section. Shifting the sleeve axially so that openings in the sleeve align with openings in the pipe establishes a flow path through the wall of the pipe section. The seals above and below the pipe ports remain covered and protected by the sliding sleeve in both the open and closed positions. In this prior art device, the flow path for fluids entering or leaving the pipe extends through the pipe ports as well as the sleeve openings. However, the surface contours of the pipe ports and the sliding sleeve openings, as well as the annular space between the sleeve and the internal pipe wall, induce turbulent flow as the fluids traverse the flow path. The turbulent flow, in turn, when combined with entrained abrasives such as sand can quickly wear away and otherwise damage the pipe and sliding sleeve assembly.

Additionally, the design of the sliding sleeve may also lead to turbulent flow in the annular space between the pipe and the casing. The turbulent flow may increase wear on the casing or the pipe, thereby decreasing their burst, collapse, and tensile capabilities. Moreover, the pipe ports are oriented radially on the pipe section, which further decreases the tensile strength of the pipe section.

There is a need, therefore, for a choke valve assembly for controlling the flow of fluid through a tubing which decreases the wear on the choke valve assembly and the surrounding wellbore. There is a further need for a choke valve assembly that reduces the turburlent flow surrounding the ports of the choke valve assembly. There is yet a further need for a method of throttling the flow of fluid through the choke valve assembly without decreasing the tensile strength of the choke valve assembly.

SUMMARY OF THE INVENTION

The present invention generally provides a choke valve assembly for controlling the flow of fluid through a production tubing. The valve assembly includes a housing having a plurality of axially aligned apertures and a ported sleeve disposed in the housing. The ported sleeve has a plurality of rows of fluid ports. Each row of ports has at least one port in selective fluid communication with a respective aperture.

In another aspect, a method of controlling fluid flow through a tubular disposed in a wellbore includes connecting a choke valve assembly to the tubular. To open the valve and establish a flow path, at least one fluid port is placed in fluid communication with the plurality of apertures. To choke the fluid flow, the ported sleeve is rotated relative to the housing to change a rate of fluid flow through the plurality of axially disposed apertures. To close the flow path, axial force is applied to move the ported sleeve axially relative to the housing.

In another aspect, the choke valve assembly is disposed eccentrically in the wellbore. As a result, a larger area between the choke valve assembly and the wellbore is created on one side of the choke valve assembly. Preferably, the apertures of the housing are oriented in the direction of the larger area.

In another aspect still, an actuator for rotating a sleeve disposed within a housing includes an outer mandrel connected to the housing and an inner mandrel connected to the sleeve. The actuator also includes an actuating sleeve disposed between the inner and outer mandrels. In operation, the actuating sleeve is moved axially relative to the outer mandrel to cause the inner mandrel to rotate.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
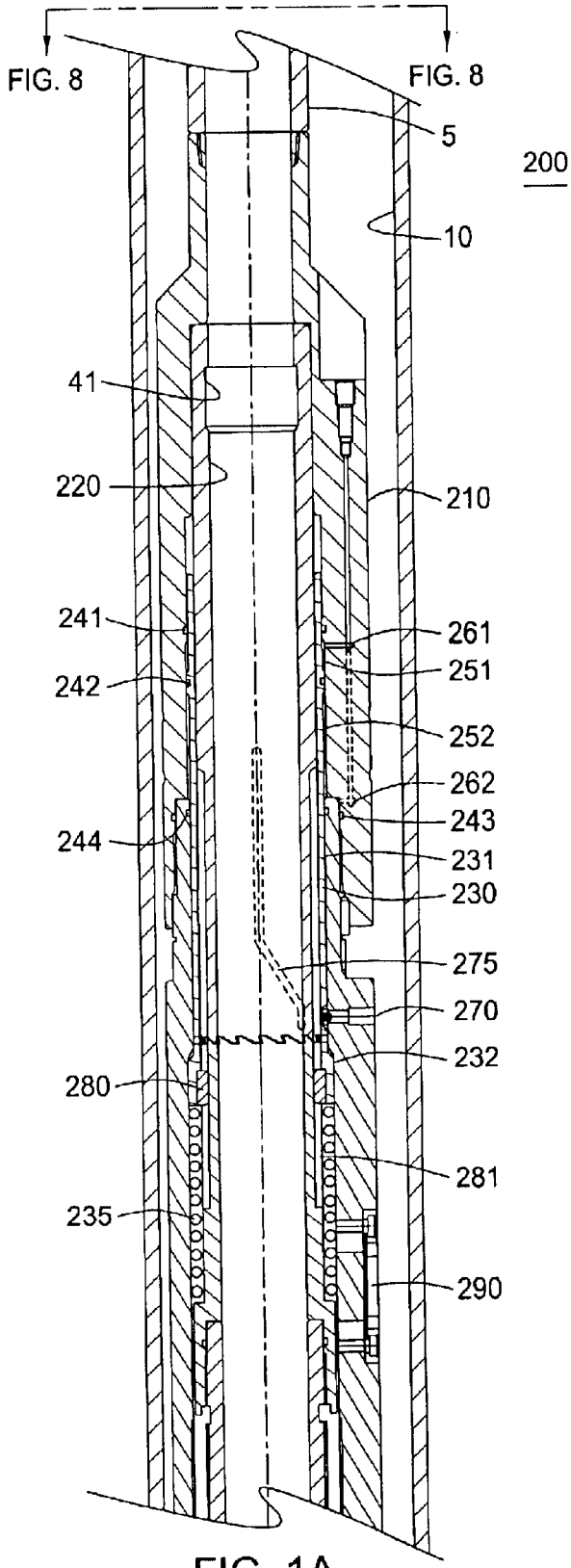
FIGS. 1A–D illustrate the choke valve assembly according to aspects of the present invention disposed in the casing. The choke valve assembly is shown in the open position and disposed eccentrically relative to the casing.
Figure 1B:
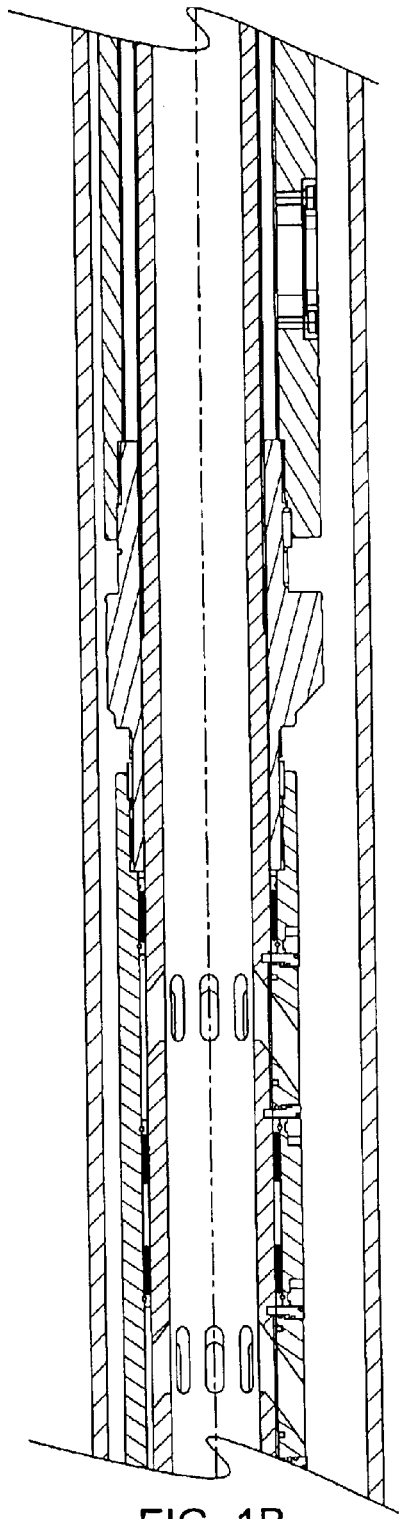
Figure 1C:
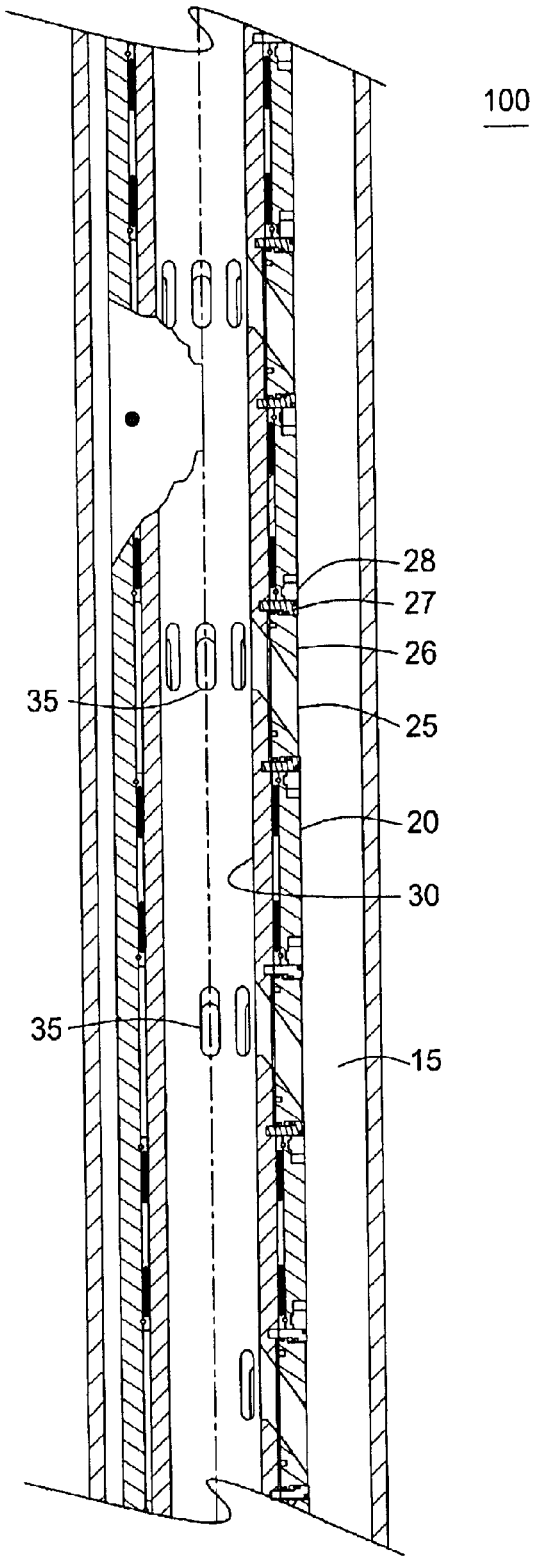
Figure 1D:
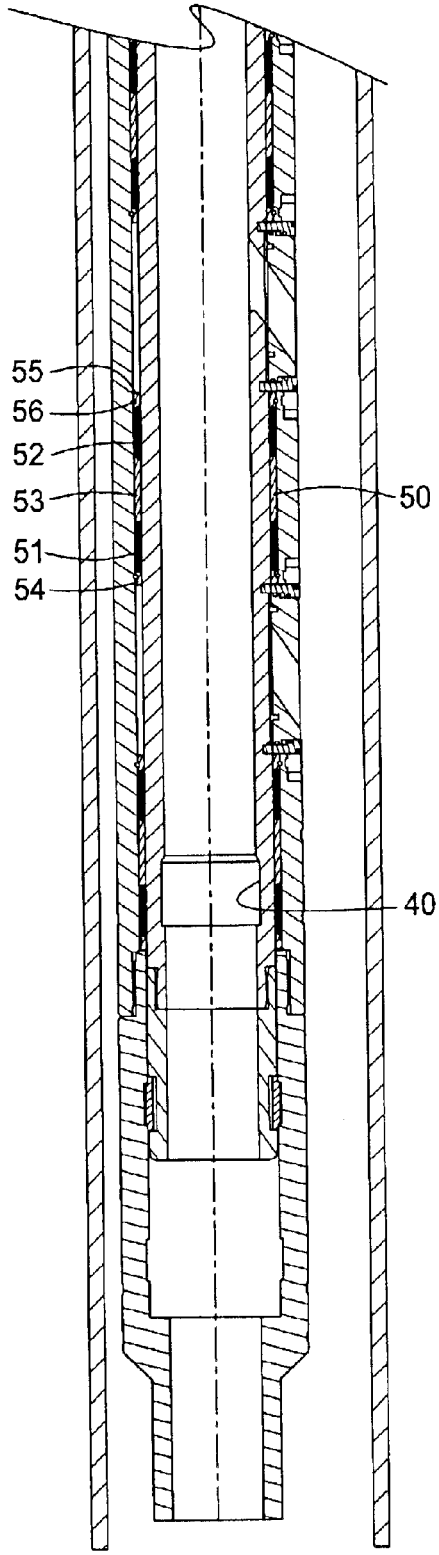
Figure 2A:
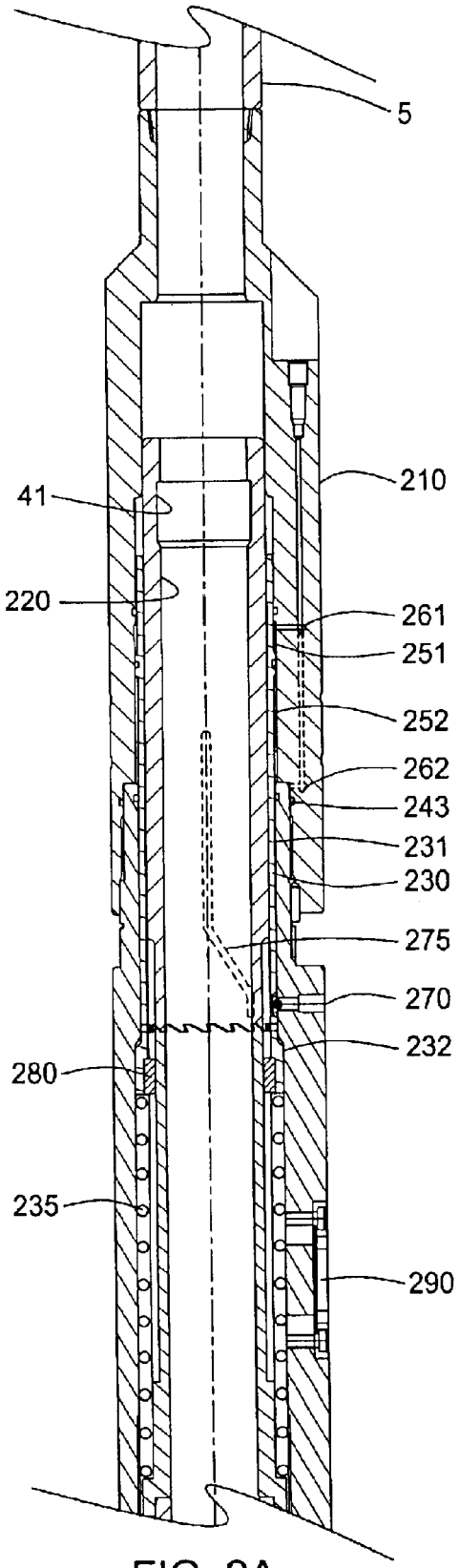
FIGS. 2A–D illustrate the choke valve assembly in the closed position.
Figure 2B:
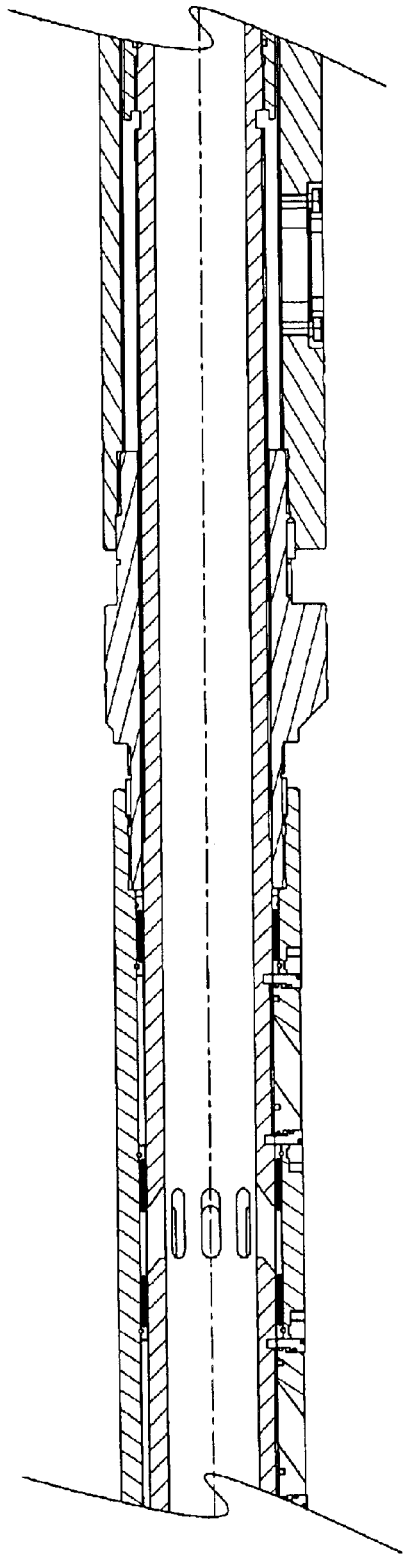
Figure 2C:
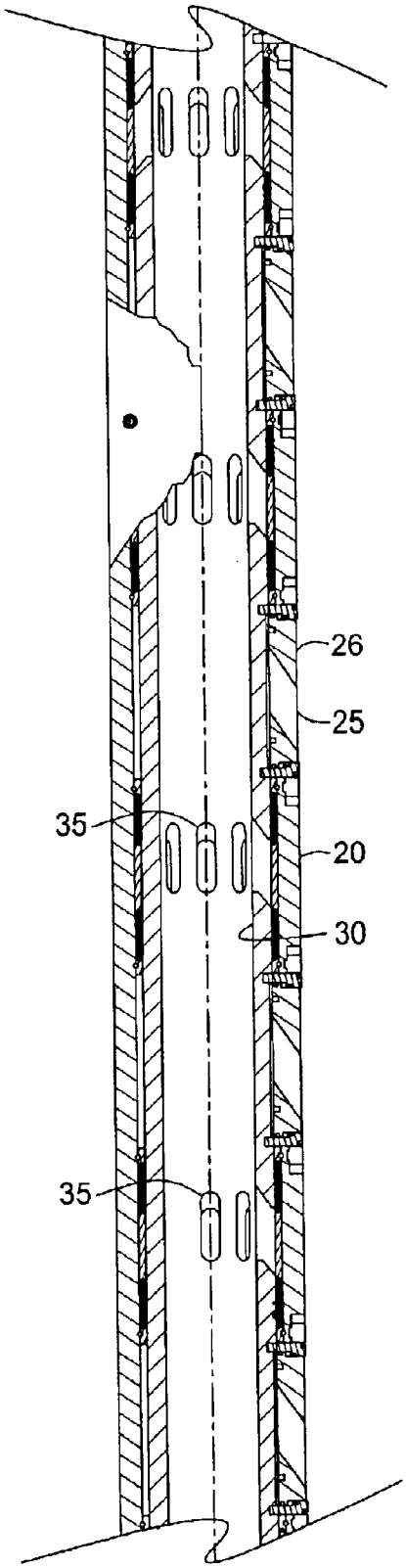
Figure 2D:
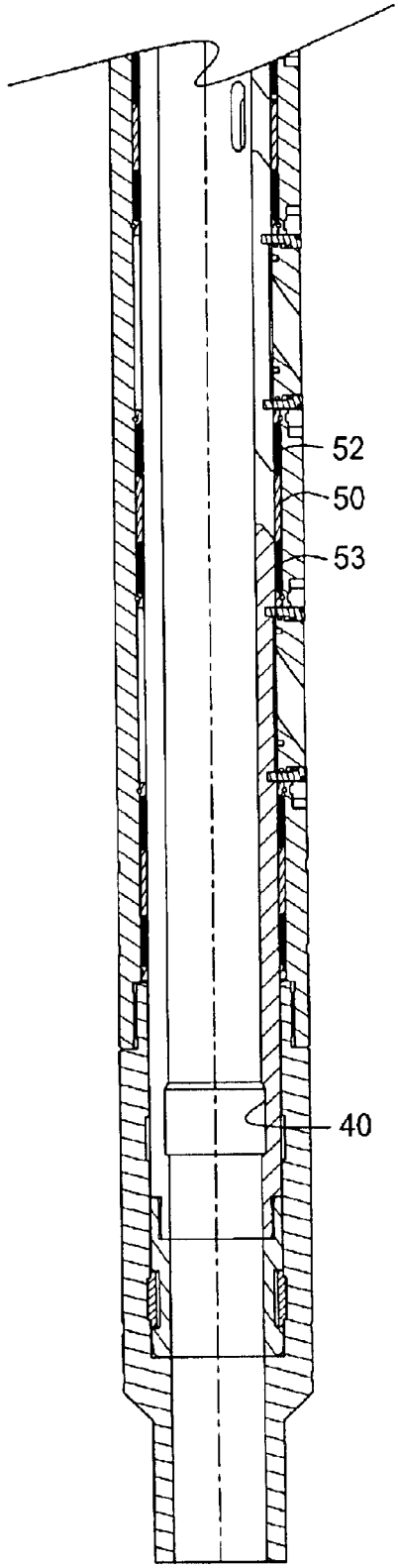
Figure 3:
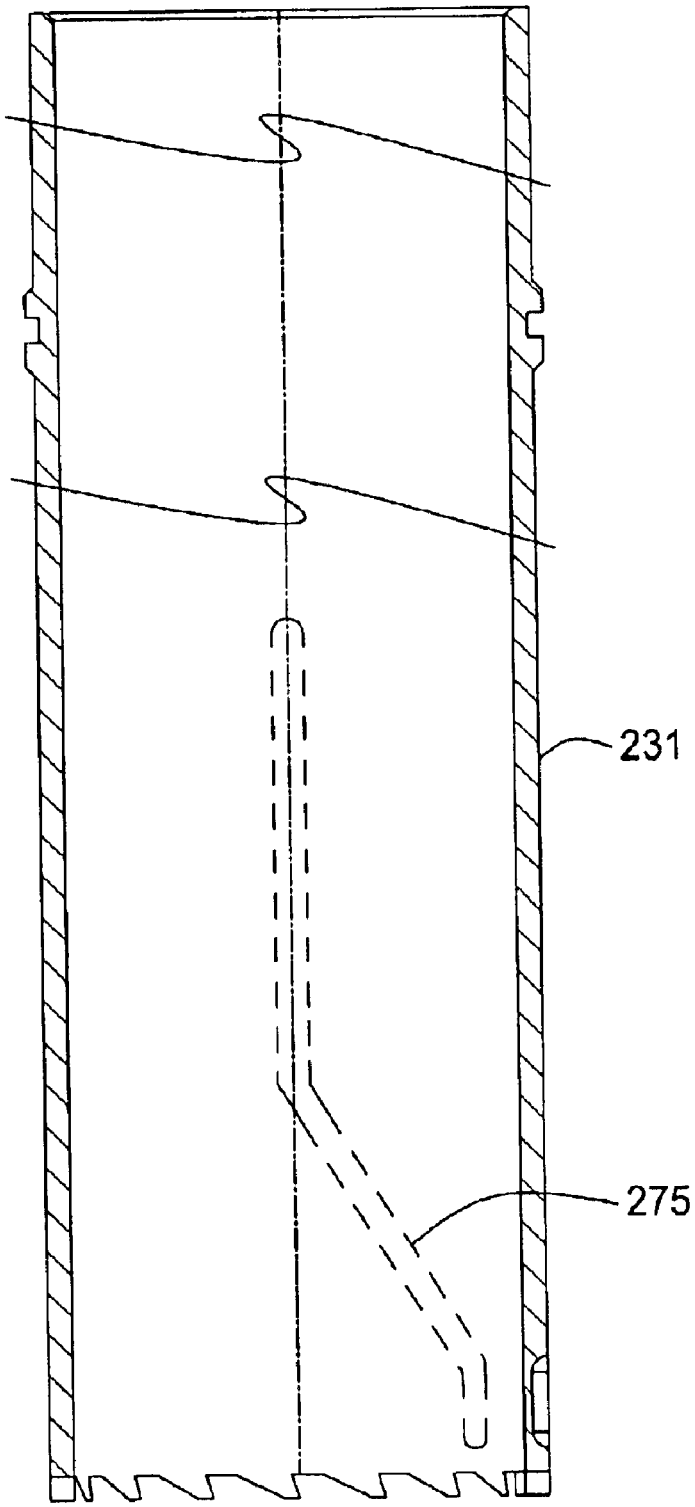
FIG. 3 shows an upper sleeve of the actuating sleeve according to aspects of the present invention.

The choke valve assembly 100 according to aspects of the present invention is generally shown in FIGS. 1A–D. The choke valve assembly 100 is adapted to be employed as part of the production tubing 5 in a cased wellbore, extending between a subsurface formation and the well surface. The choke valve assembly 100 may be used control the flow of fluids between the production tubing 5 and the well. Although embodiments of the present invention are described in application with a cased wellbore, aspects of present invention are equally applicable to a non-cased or open wellbore.

As seen in FIG. 1, the choke valve assembly 100 is shown with an actuator 200 attached and disposed in a casing 10. The choke valve assembly 100 includes a tubular housing 20 having a plurality of apertures 25 and a ported sleeve 30 disposed therein. Preferably, the apertures 25 are disposed on the housing 20 in axial alignment. In one embodiment, eight apertures 25 are formed in axial alignment on the housing 20. However, any number of apertures 25 may be formed to provide the desired fluid flow rate. One advantage of positioning the apertures 25 axially instead of radially is that the tensile strength of the choke valve assembly 100 is substantially retained. Another advantage is that any wash-out that may occur to the casing 10 or the choke valve assembly 100 is distributed over a larger surface area, thereby prolonging the life of the valve assembly 100 and the casing 10. In another aspect, the apertures 25 may be angled relative to the central axis of the choke valve assembly. It is believed that the angled apertures 25 may provide a smoother fluid flow from the wellbore annulus 15 and the production tubing 5, thereby reducing the turbulence flow surrounding the aperture 25.

Figure 6:
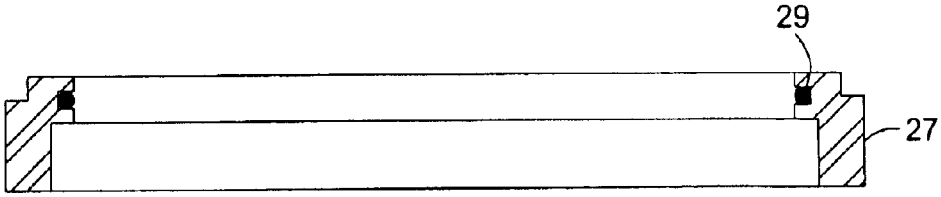
FIG. 6 shows a cross-sectional view of one embodiment of a cap usable with the insert shown in FIG. 7.
Figure 7A:
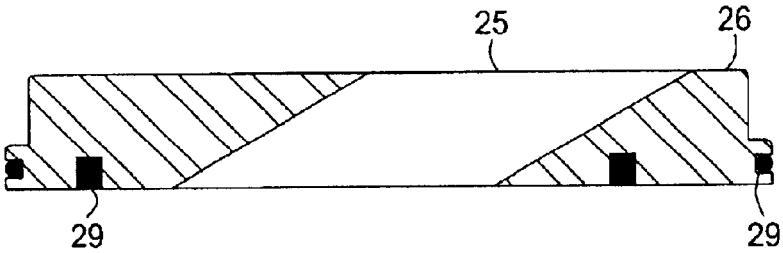
FIGS. 7A–B show a cross-sectional view of the insert and a side view of the insert, respectively.
Figure 7B:
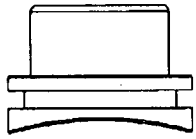

In another aspect, the apertures 25 may be formed as part of an insert 26 which is selectively attached to the housing 20 using a cap 27 and a lock 28. FIG. 6 shows a cross-sectional view of one embodiment of the cap 27 and FIGS. 7A and 7B show a cross-sectional view of the insert 26 and a side view of the insert 26, respectively. As seen in the Figures, the cap 27 may be placed over the insert 26 to retain the insert 26 in the housing 20. Seals 29 may be provided to close off control the fluid path or prevent undesired leakage. The inserts 26 increase the versatility of the choke valve assembly 100 because it allows apertures 25 of different sizes to be used without greatly increasing the costs of manufacturing. For example, the housing 20 may be fitted with inserts 26 having the same size apertures 25. Alternatively, the housing 20 may be fitted with inserts 26 having different size apertures 25 to provide more flexibility in controlling the fluid flow. However, it must be noted that aspects of the present invention also contemplates forming the apertures 25 integral to the housing 20.

FIG. 1 shows the ported sleeve 30 disposed in the housing 20 in the open position. Preferably, the ported sleeve 30 is co-axially disposed in the housing 20 and capable of rotational and axial movement relative to the housing 20. The ported sleeve 30 defines a tubular having a plurality of rows of fluid ports 35. Preferably, the number of rows of fluid ports 35 is the same as the number of apertures 25 formed on the housing 20. In the open position, each row of fluid ports 35 is aligned with a respect aperture 25. Moreover, each row has at least one port 35 in selective fluid communication with the respective aperture 25. In one embodiment, each row has a different number of fluid ports 35 with the maximum number of fluid ports 35 in one row equaling the total number of apertures 25.

In the embodiment shown in FIG. 1, the housing 20 is shown with eight apertures 25 and the ported sleeve 30 is shown with eight rows of fluid ports 35. Each row of ports 35 is aligned and in selectively fluid communication with a respective aperture 25. Furthermore, the first row has a total of eight ports 35 formed thereon, while each successive row has one less port 35 than the previous row. Ending with the last row having only one port 35. It must be noted that the ports 35 of the last two rows are not shown in FIG. 1 solely because of the perspective view taken in FIG. 1.

In another aspect, each row of ports 35 is arranged in a manner such that rotation of the ported sleeve 30 will place a different number ports 35 in fluid communication with the apertures 25. For example, the eight ports 35 of the first row are circumferentially spaced apart at 45 degrees from each other. The seven ports 35 of the second row are formed such that they axially align with seven ports 35 of the first row. The six ports 35 of the third row are formed such that they axially align with six ports 35 of the first and second rows. This arrangement continues until the one port 35 of the last row axially aligns with one port 35 of the first seven rows. In this respect, each 45 degree rotation of the ported sleeve 30 relative to the housing 20 will place a different number of ports 35 in fluid communication with the apertures 25. In this manner, the flow of fluid through the choke valve assembly 100 may be controlled or choked by rotating the ported sleeve 30 relative to the housing 20. Although the rows of ports 35 are shown in incremental arrangement, it must be noted that the rows may be arranged in any order so long as a different number of ports 35 is placed in fluid communication with each rotation of the ported sleeve 30.

In another aspect, the ports 35 of the ported sleeve 30 may be formed at the same angle as the apertures 25 of the housing 20. In this respect, the turbulent flow from the annulus 15 to the tubing 5 is further reduced. Because the sizes of the apertures 25 are easily changed by changing the inserts 26, it is preferred that the same size ports 35 are formed on the ported sleeve 30 to decrease manufacturing costs. However, ports 35 may also be formed with different sizes and at different angles without deviating from the aspects of the present invention.

The choke valve assembly 100 of the present invention may be closed by axially moving the ported sleeve 30 relative to the housing 20, thereby blocking off fluid communication between the ports 35 and the apertures 25 as shown in FIG. 2. Preferably, the ported sleeve 30 is moved by inserting a collet (not shown) to contact a seat 40 in the ported sleeve 30. After contacting the seat 40, an axial force may be applied to the collet to cause the ported sleeve 30 to move axially.

Aspects of the present invention further provide a seal system 50 to effect sealing between the housing 20 and the ported sleeve 30. In one aspect, the seal system 50 may be placed between adjacent apertures 25. The seal system 50 includes two seal stacks 51, 52 disposed between a primary spacer 53. The seal stacks 51, 52 may include one or more seals disposed adjacent to another seal. At each end of the seal system 50, a secondary spacer 54, 55 is disposed between one of the seal stacks 51, 52 and the cap 27 of the insert 26 adjacent each end of the seal system 50. In one embodiment, the seal system 50 may be axially secured by placing rod inserts 56 between each secondary spacer 54, 55 and the housing 20. In another embodiment (not shown), additional spacers may be placed between the secondary spacers 54, 55.

One advantage of the seal system 50 of the present invention is that the seal system 50 is isolated from differential pressure during operation of the choke valve 100. In the open and choked positions, both ends of the seal system 50 experience the same pressure because each end is in fluid communication with an aperture 25. As a result, there is no pressure differential across the seal system 50. By isolating the seal system 50 from a pressure differential, the stacked seals 51, 52 remain unworn and retain its sealing capabilities. When the choke valve assembly 100 is closed, the seal system 50 may effectively prevent fluid from entering the production tubing 5.

As discussed above, the flow of fluid through the tubing 5 may be choked by rotating the ported sleeve 30 relative to the housing 20. FIG. 1 shows an embodiment of an actuator 200 adapted and designed to rotate the ported sleeve 30. As shown, the actuator 200 is operatively attached to an upper portion of the choke valve assembly 100. The actuator 200 includes an outer mandrel 210 connected to the housing 20 and an inner mandrel 220 connected to the ported sleeve 30. The inner mandrel 220 is rotatably and axially movable relative to the outer mandrel 210. The inner mandrel 220 may include a seat 41 for mating with a collet to provide axial movement to the inner mandrel 220.

An actuating sleeve 230 is disposed in an annular area between the inner and outer mandrels 220, 210. The actuating sleeve 230 includes an upper sleeve 231 and a lower sleeve 232. One end of the upper sleeve 231 has teeth that mate with the teeth on the lower sleeve 232. The mating teeth are designed such that the rotation of the upper sleeve 231 in one direction will cause the lower sleeve 232 to rotate in the same direction, but rotation of the upper sleeve 231 in an opposite direction will not cause the lower sleeve 232 to rotate. A biasing mechanism 235 such as a spring is used to bias the teeth of the lower and upper sleeves 231, 232 into contact.

Figure 8:
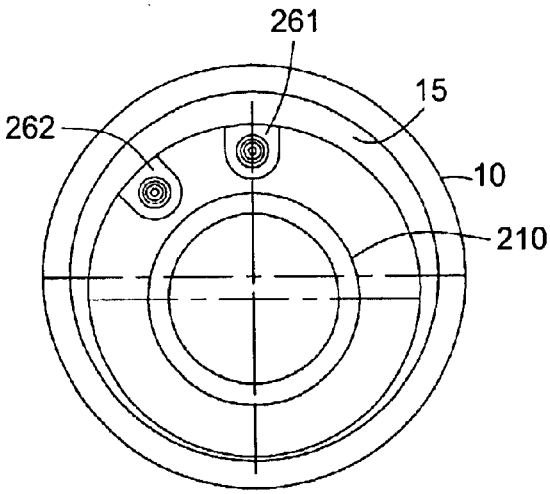
FIG. 8 shows a top view of the actuator of the present invention disposed in the casing.

One or more seals 241–244 are used to form two fluid chambers 251, 252 between an outer surface of the upper sleeve 231 and an inner surface of the outer mandrel 210. A first injection port 261 may be formed in the outer mandrel 210 to supply fluid to the first fluid chamber 251. A second injection port 262 may be formed in the outer mandrel 210 to supply fluid to the second fluid chamber 252. As fluid is supplied to the first fluid chamber 251 through the first injection port 261, the actuator sleeve 230 is caused to move axially relative to the outer mandrel 210, thereby increasing the size of the first fluid chamber 251 in order to accommodate the injected fluid. On the other hand, when fluid is supplied to the second fluid chamber 252, the actuator 230 is caused to move axially in a direction that increases the size of the second fluid chamber 252 and decreases the size of the first fluid chamber 251. FIG. 8 is a top view of the actuator 200 of the present invention disposed in the casing 10. In one embodiment, the first and second injection ports 261, 262 may be arranged as shown in FIG. 8.

Rotation of the actuating sleeve 230 is effectuated through a key 270 and groove 275 arrangement. The outer mandrel 210 may include an actuating key 270 at least partially disposed in an actuating groove 275 of the upper sleeve 231. As shown in FIG. 1, the actuating groove 275 is designed to cause the upper sleeve 231 to rotate as it is moved axially relative to the outer mandrel 210. When the first fluid chamber 251 is expanded, the upper sleeve 231 moves axially and rotatably in a manner dictated by the actuating key 270 and the actuating groove 275. In one embodiment, the upper sleeve 231 is caused to rotate 45 degrees relative to the outer mandrel 210. When the second fluid chamber 252 is expanded, the upper sleeve 231 is caused to rotate in the opposite direction.

Figure 4:
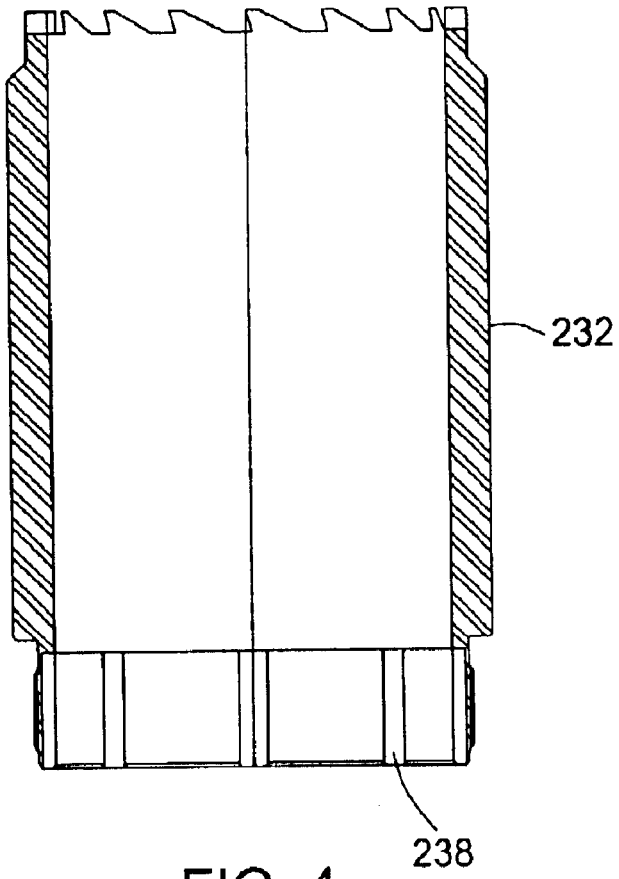
FIG. 4 shows a lower sleeve of the actuating sleeve according to aspects of the present invention.
Figure 5:
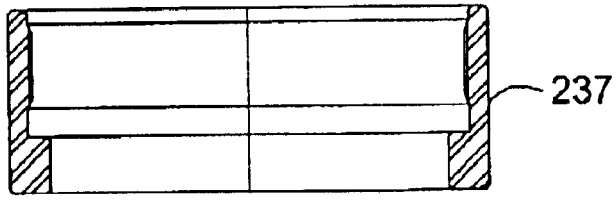
FIG. 5 shows an end portion attachable to the lower sleeve.

A rod insert 280 connected to an inner surface of the lower sleeve 232 may be axially disposed between the lower sleeve 232 and the inner mandrel 220. As shown in FIGS. 4 and 5, the rod insert 280 may be longitudinally disposed in a recess 238 between the lower sleeve 232 and an end portion 237. Additionally, the rod insert 280 may at least partially reside in an axial groove 281 formed on an outer surface of the inner mandrel 220. The rod insert 280 is designed to movably connect the inner mandrel 220 to the lower sleeve 232. Specifically, the rod insert 280 is designed to impart a rotational force to the inner mandrel 220 when the lower sleeve 232 is rotated, and allow the lower sleeve 232 to move axially relative to the inner mandrel 220. In another embodiment, the lower sleeve 232 may selectively attach to the inner mandrel 220 using a spline and groove connection or any other connection that allows rotational force, but not axial force, to be transferred to the inner mandrel 220, as is known to a person of ordinary skill in the art.

In another aspect, a filter or screen 290 may be disposed in the outer mandrel 210 to expose the annular area containing the biasing mechanism 235. In this respect, pressure may equalize between the annular area and the wellbore to facilitate the movement of the biasing mechanism 235.

In another aspect, the valve assembly 100 of the present invention is positioned eccentrically relative to the casing 10 as shown in FIGS. 1 and 8. By positioning the valve assembly 100 eccentrically, a larger distance on one side of the valve assembly 100 is created between the valve assembly 100 and the casing 10. Preferably, the apertures 25 are oriented in the direction of the side having the larger distance. Thus, wellbore fluids are allowed to enter the tubing 5 from the side exposed to the larger area. It is believed that the larger area created by positioning the valve assembly 100 eccentrically in the casing 10 promotes a more laminar fluid flow that enters the apertures 25, thereby decreasing the turbulence and wear on the valve assembly 100 and the casing 10.

In operation, the choke valve assembly 100 of the present invention is connected to a production tubing 5 and lowered into the wellbore. The production tubing 5 may include packers or plugs to isolate a prospective production zone. As seen in FIG. 1, the choke valve assembly 100 is equipped with an actuator 200 adapted and designed to rotate the ported sleeve 30 in order to control or choke the flow of fluid entering the production tubing 5. The choke valve assembly 100 is lowered into the wellbore and placed eccentrically relative to the casing 10. Further, the valve assembly 100 is disposed in the casing 10 in a manner such that the apertures 25 of the housing 20 are open to the larger radial distance between the valve assembly 100 and the casing 10.

Figure 9:
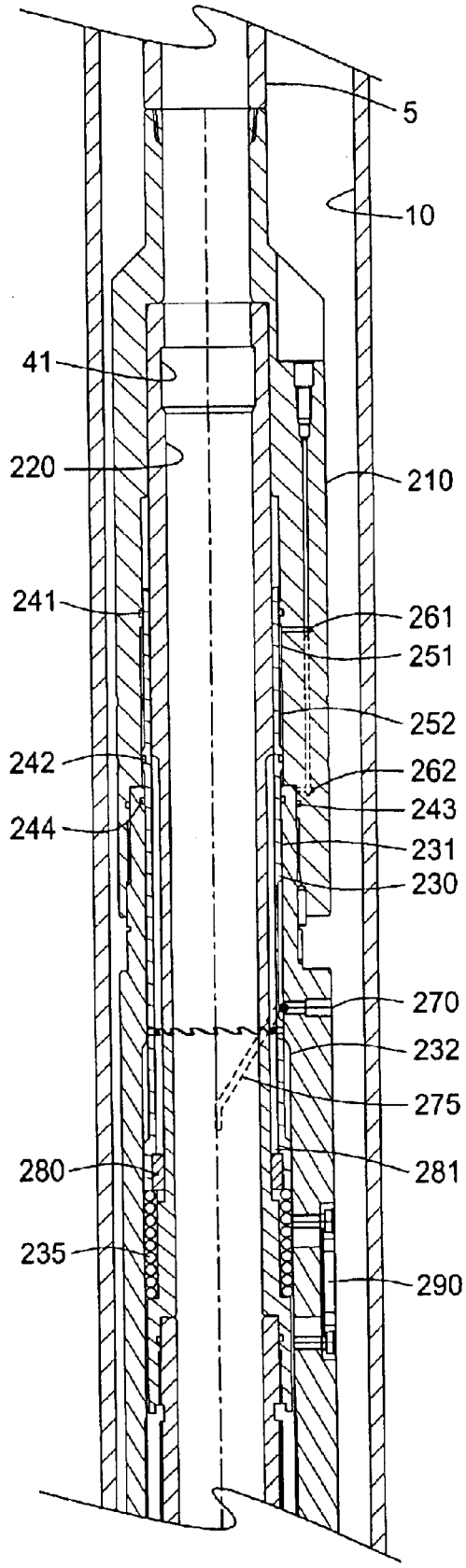
FIG. 9 shows the actuating sleeve moved axially and rotated.

Initially, the valve assembly 100 is in the full open position, in which all of the apertures 25 are open to fluid flow as shown in FIG. 1. To choke the fluid flow, fluid is injected into the first fluid chamber 251 through the first injection port 261. In turn, the first fluid chamber 251 is caused to expand, thereby moving the upper sleeve 231 axially relative to the outer mandrel 210. The upper sleeve 231 moves in accordance with the actuating groove 275 which is guided by the actuating key 270. As a result, the upper sleeve 231 is rotated 45 degrees. Because the upper sleeve 231 is rotatably connected to the lower sleeve 232 through the teeth formed thereon, the lower sleeve 232 is also cause to rotate 45 degrees. In turn, the rod insert connection causes the inner mandrel 220 to also rotate 45 degrees as shown in FIG. 9. In this manner, the ported sleeve 30 is rotated 45 degrees, thereby reducing the number of ports 35 in fluid communication with the apertures 25. In this manner, the rate of fluid flowing into the choke valve assembly 100 and the production tubing 5 may be controlled or changed. Also seen in FIG. 9 is that the actuating sleeve 230 is moved axially relative to the inner and outer mandrels 210, 220. In this position, the biasing mechanism 235 is compressed. Furthermore, the actuating key 270 is positioned toward the other end of the actuating groove 275.

In order to rotate the ported sleeve 30 further, the actuating sleeve 230 must first return to the initial position. The return process begins with injecting fluid to the second fluid chamber 252 through the second injection port 262. This causes the actuating sleeve 230 to move in the axial direction that expands the second fluid chamber 252 and compresses the first fluid chamber 251. Further, the upper sleeve 231 is rotated in the opposition direction as the actuating sleeve 230 moves axially. However, the lower sleeve 232 is not caused to rotate due to the design of the teeth connecting the lower sleeve 232 to the upper sleeve 231. In other words, the upper sleeve 231 is rotated relative to the lower sleeve 232. Although the lower sleeve 232 does not rotate, it nevertheless travels axially because of the biasing mechanism 235. At the end of the return process, the actuator 200 is substantially positioned as shown in FIG. 1 and ready to rotate the ported sleeve 30 as needed. It must be noted that the ported sleeve 30 remains in the choked position even though the actuator has returned to the initial position. In this manner, fluid flow through the choke valve assembly 100 may be controlled as necessary.

To close the choke valve assembly 100, a collet may be inserted into the choke valve assembly 100 to move the ported sleeve 30 axially relative to the housing 20. Specifically, a collet may be inserted into the valve assembly 100 to contact a seat 40 formed in the valve assembly 100. After contacting the seat 40, an axial force may be applied to the collet to cause the ported sleeve 30 to move axially relative to the housing 30. In this manner, the ports 35 of the ported sleeve 30 may be blocked off from fluid communication with the apertures 25 of the housing 20 as shown in FIG. 2. In this position, the seal system 50 effectively seals off the ports 35 from the apertures 25. To reopen the choke valve assembly 100, the collet may be re-inserted to contact seat 41. Thereafter, axial force may be applied to the ported housing 30 to cause the ports 35 to realign with the apertures 25. Although separate seats 40, 41 are used to open and close the choke valve assembly 100, it is contemplated that a single seat may be designed to both open and close the choke valve assembly 100. Further, other methods or apparatus of opening or closing the valve assembly 100 are also contemplated within aspects of the present invention so long as they are capable of moving the ported sleeve 30 axially relative to the housing 20.

While the foregoing is directed to embodiments of the present invention, other and further embodiments of the invention may be devised without departing from the basic scope thereof, and the scope thereof is determined by the claims that follow.

I claim:

1. A choke valve assembly, comprising:

a tubular housing having a plurality of axially disposed apertures; and a ported sleeve disposed within the housing for selective axial and rotational movement relative to the housing, the ported sleeve having a plurality of rows of fluid ports, wherein each row of fluid ports has at least one port adapted for selective fluid communication with a respective aperture and wherein at least two rows of fluid ports have a different number of ports.

2. The choke valve assembly of claim 1, wherein rotation of the ported sleeve relative to the housing changes a rate of fluid flow through the choke valve assembly.

3. The choke valve assembly of claim 1, wherein the choke valve assembly is closed by moving the ported sleeve axially relative to the housing.

4. The choke valve assembly of claim 1, wherein each row of fluid ports has a different number of ports.

5. The choke valve assembly of claim 1, wherein the maximum number of ports in one row equal to the number of apertures.

6. The choke valve assembly of claim 1, wherein each row of ports has at least one port in axial alignment with a port of another row.

7. The choke valve assembly of claim 1, wherein the plurality of apertures is angled relative to a central axis of the choke valve assembly.

8. The choke valve assembly of claim 7, wherein the fluid ports are placed at the same angle as the plurality of apertures.

9. The choke valve assembly of claim 1, wherein the fluid ports are angled relative to the central axis of the choke valve assembly.

10. The choke valve assembly of claim 1, wherein the plurality of apertures is formed on an insert that is attachable to the housing.

11. The choke valve assembly of claim 1, wherein the choke valve assembly comprises eight axially aligned apertures.

12. The choke valve assembly of claim 11, wherein the ported sleeve comprises eight rows of fluid ports.

13. The choke valve assembly of claim 12, wherein each row of ports has a different number of ports.

14. The choke valve assembly of claim 13, wherein at least one row comprises eight fluid ports circumferentially spaced apart.

15. The choke valve assembly of claim 1, further comprising an actuator for rotating the ported sleeve relative to the housing.

16. The choke valve assembly of claim 1, further comprising a seal system.

17. The choke valve assembly of claim 16, wherein the seal system is secured axially using a rod insert.

18. A method of controlling fluid flow through a tubular disposed in a wellbore, comprising:

providing a choke valve assembly to the tubular, the choke valve assembly having:

a tubular housing having a plurality of axially disposed apertures; and a ported sleeve disposed within the housing for selective axial and rotational movement relative to the housing, the ported sleeve having a plurality of rows of fluid ports, wherein each row of fluid ports has at least one port in selective fluid communication with a respective aperture;

placing at least one fluid port in fluid communication with one of the apertures; and rotating the ported sleeve relative to the housing to change a number of fluid ports in fluid communication with the aperture, thereby changing a rate of fluid flow through the plurality of axially disposed apertures.

19. The method of claim 18, wherein the choke valve assembly is disposed eccentrically relative to the wellbore.

20. The method of claim 19, wherein the plurality of apertures are oriented in the direction of the side having a larger distance between the wellbore and the choke valve assembly.

21. The method of claim 18, further comprising moving the ported sleeve axially relative to the housing to close or open the choke valve assembly.

22. The method of claim 18, wherein an actuator attached to the choke valve assembly is used to rotate the ported sleeve.

23. An actuator for rotating a sleeve disposed within a housing, comprising:

an outer mandrel connected to the housing;

an inner mandrel connected the sleeve, wherein the inner mandrel is disposed within the outer mandrel; and an actuating sleeve disposed between the inner and outer mandrels, wherein moving the actuating sleeve axially relative to the outer mandrel causes the inner mandrel to rotate.

24. The actuator of claim 23, further comprising:

a first fluid chamber and a second fluid chamber formed between the actuating sleeve and the outer mandrel;

a first injection port connected to the first fluid chamber; and a second injection port connected to the second fluid chamber.

25. The actuator of claim 24, wherein supplying fluid to the first fluid chamber causes the actuating sleeve to move in one axial direction and supplying fluid to the second fluid chamber causes the actuating sleeve to move in the opposite axial direction.

26. The actuator of claim 23, wherein the actuating sleeve is selectively connected to the inner mandrel using a connection that imparts rotational force but not axial force.

27. The choke valve assembly of claim 16, wherein the seal system comprises:

two seal stacks;

a primary spacer disposed between the two seal stacks; and a secondary spacer disposed adjacent to each of the seal stacks.

28. The choke valve assembly of claim 27, wherein the seal system is disposed between two adjacent apertures.

29. A choke valve assembly, comprising:

a tubular housing having a plurality of axially disposed apertures; and a ported sleeve disposed within the housing for selective axial and rotational movement relative to the housing, the ported sleeve having a plurality of rows of fluid ports, wherein each row of fluid ports has at least one port in selective fluid communication with a respective aperture and wherein the fluid ports are angled relative to the central axis of the choke valve assembly.

30. A choke valve assembly, comprising:

a tubular housing having a plurality of axially disposed apertures; and a ported sleeve disposed within the housing for selective axial and rotational movement relative to the housing, the ported sleeve having a plurality of rows of fluid ports, wherein each row of fluid ports has at least one port in selective fluid communication with a respective aperture and wherein the plurality of apertures is formed on an insert that is attachable to the housing.

31. A choke valve assembly, comprising:

a tubular housing having a plurality of axially disposed apertures;

a ported sleeve disposed within the housing for selective axial and rotational movement relative to the housing, the ported sleeve having a plurality of rows of fluid ports, wherein each row of fluid ports has at least one port in selective fluid communication with a respective aperture; and a seal system secured axially using a rod insert.

32. A choke valve assembly, comprising:

a tubular housing having a plurality of axially disposed apertures;

a ported sleeve disposed within the housing for selective axial and rotational movement relative to the housing, the ported sleeve having a plurality of rows of fluid ports, wherein each row of fluid ports has at least one port in selective fluid communication with a respective aperture; and a seal system comprising:

two seal stacks;

a primary spacer disposed between the two seal stacks; and a secondary spacer disposed adjacent to each of the seal stacks.

33. The choke valve assembly of claim 32, wherein the seal system is disposed between two adjacent apertures.

34. A method of controlling fluid flow through a tubular disposed in a wellbore, comprising:

providing a choke valve assembly to the tubular, the choke valve assembly having:

a tubular housing having a plurality of axially disposed apertures; and a ported sleeve disposed within the housing for selective axial and rotational movement relative to the housing, the ported sleeve having a plurality of rows of fluid ports, wherein each row of fluid ports has at least one port in selective fluid communication with a respective aperture;

disposing the choke valve assembly eccentrically relative to the wellbore;

placing at least one fluid port in fluid communication with one of the apertures; and rotating the ported sleeve relative to the housing to change a rate of fluid flow through the plurality of axially disposed apertures.

35. The method of claim 34, wherein the plurality of apertures are oriented in the direction of the side having a larger distance between the wellbore and the choke valve assembly.

36. A choke valve assembly, comprising:

a tubular housing having at least one axially disposed aperture;

a ported sleeve disposed within the housing for selective axial and rotational movement relative to the housing, the ported sleeve having a plurality of rows of fluid ports, wherein each of the plurality of rows of fluid ports has at least one port adapted for selective fluid communication with the at least one aperture, wherein rotation of the ported sleeve relative to the housing changes a number of fluid ports in fluid communication with the at least one aperture, thereby changing a rate of fluid flow through the choke valve assembly.

37. The choke valve assembly of claim 36, wherein the fluid ports vary in size.

38. A method of controlling fluid flow through a tubular disposed in a wellbore, comprising:

providing a choke valve assembly to the tubular, the choke valve assembly having:

a tubular housing having at least one axially disposed aperture; and a ported sleeve disposed within the housing, the ported sleeve having a plurality of rows of fluid ports, wherein each row of fluid ports has at least one port in selective fluid communication with the at least one aperture;

placing at least one fluid port in fluid communication with the at least one aperture; and rotating the ported sleeve relative to the housing to change a number of fluid ports in fluid communication with the at least one aperture, thereby changing a rate of fluid flow through the plurality of axially disposed apertures.

39. The method of claim 38, wherein the choke valve assembly is disposed eccentrically relative to the wellbore.

40. The method of claim 39, wherein the plurality of apertures are oriented in the direction of the side having a larger distance between the wellbore and the choke valve assembly.

41. The method of claim 38, further comprising moving the ported sleeve axially relative to the housing to close or open the choke valve assembly.

42. The method of claim 38, wherein an actuator attached to the choke valve assembly is used to rotate the ported sleeve.

* * * * *